US010343822B2

(12) United States Patent
Hillmann et al.

(10) Patent No.: US 10,343,822 B2
(45) Date of Patent: Jul. 9, 2019

(54) CROWN CAP CLOSURE AND CLOSURE METHOD

(71) Applicants: Heinz Hillmann, Obrigheim (DE); Andreas Krieg, Dittelsheim-Hessloch (DE)

(72) Inventors: Heinz Hillmann, Obrigheim (DE); Andreas Krieg, Dittelsheim-Hessloch (DE)

(73) Assignee: KHS GmbH, Dortmund (DE)

( * ) Notice: Subject to any disclaimer, the term of this patent is extended or adjusted under 35 U.S.C. 154(b) by 0 days.

(21) Appl. No.: 15/277,018

(22) Filed: Sep. 27, 2016

(65) Prior Publication Data

US 2017/0081087 A1 Mar. 23, 2017

Related U.S. Application Data

(63) Continuation-in-part of application No. PCT/EP2015/056266, filed on Mar. 24, 2015.

(30) Foreign Application Priority Data

Mar. 27, 2014 (DE) ..... 10 2014 104 323

(51) Int. Cl.
*B65D 41/02* (2006.01)
*B65D 41/12* (2006.01)
(Continued)

(52) U.S. Cl.
CPC ..... *B65D 41/12* (2013.01); *B65C 3/26* (2013.01); *B65D 53/02* (2013.01); *B67B 3/023* (2013.01); *B67C 3/24* (2013.01); *B67C 3/28* (2013.01); *B67C 7/004* (2013.01); *B67C 2003/228* (2013.01)

(58) Field of Classification Search
CPC ..... B65D 41/02; B65D 41/023; B65D 41/10; B65D 41/105; B67B 3/02; B67B 3/023
USPC ..... 215/324, 327, 320; 53/137.1, 324, 329, 53/331, 423, 485, 477
See application file for complete search history.

(56) References Cited

U.S. PATENT DOCUMENTS 2,961,109 A * 11/1960 Podesta ..... B65D 41/40 215/327
2,974,816 A * 3/1961 Ford ..... B65D 41/12 215/328
(Continued)

FOREIGN PATENT DOCUMENTS

DE 1018121 10/1957
DE 3515334 10/1986
(Continued)

*Primary Examiner* — Gloria R Weeks
(74) *Attorney, Agent, or Firm* — Nils H. Ljungman & Associates

(57) ABSTRACT

Crown caps comprising jag-like or tooth-like shaped ends, wherein one or a plurality of cavities is formed between an outer container surface and the shaped ends, and wherein in the region of the shaped ends a deformable sealing material is provided which closes the cavities at least to the extent of the edge of the crown cap that points to the base of the container, with the sealing material forming a ring-like or hoop-like element separate from the crown cap and which interacts with the crown cap in such a way that when the shaped ends are deformed for the container closure they press or sink into the sealing material.

20 Claims, 15 Drawing Sheets

(51) Int. Cl.

| | |
|---|---|
| ***B65C 3/26*** | (2006.01) |
| ***B65D 53/02*** | (2006.01) |
| ***B67B 3/02*** | (2006.01) |
| ***B67C 3/24*** | (2006.01) |
| ***B67C 3/28*** | (2006.01) |
| ***B67C 7/00*** | (2006.01) |
| *B67C 3/22* | (2006.01) |

(56) References Cited

U.S. PATENT DOCUMENTS 3,012,687 A * 12/1961 Dallay ..... B65D 41/12 215/254
3,032,225 A * 5/1962 Hårding ..... B65D 51/20 215/250
3,104,773 A * 9/1963 Dallay ..... B21D 51/46 215/327
3,147,874 A * 9/1964 Hundt ..... B65D 41/12 215/328
3,158,276 A * 11/1964 Luertzing ..... B65D 41/12 215/327
3,286,867 A * 11/1966 Mumford ..... B65D 41/0442 215/321
3,339,772 A * 9/1967 Miller ..... B65D 41/28 215/277
3,372,527 A * 3/1968 Vignati ..... B67B 3/14 53/358
3,473,684 A * 10/1969 Wagner ..... B65D 41/0442 215/324
3,557,987 A * 1/1971 Singer, Jr. ..... B65D 41/12 206/831
3,559,833 A * 2/1971 Alonso ..... B65D 1/0246 215/324
3,604,178 A * 9/1971 Bluhm ..... B21D 51/383 53/412
3,660,963 A * 5/1972 Sullivan ..... B67B 3/12 53/201
3,706,176 A * 12/1972 Leatherman ..... B29C 65/1425 156/262
3,827,594 A * 8/1974 Leenaards ..... B65D 41/0442 215/252
3,842,574 A * 10/1974 Dickey ..... B29C 43/14 29/458
3,868,038 A * 2/1975 Hadley ..... B65D 41/0464 215/305
3,952,900 A * 4/1976 Rausing ..... B65D 41/48 215/232
3,963,845 A * 6/1976 Dukess ..... B65D 41/045 428/66.4
4,099,361 A * 7/1978 Dix ..... B67B 3/18 53/201
4,111,323 A * 9/1978 Ichinose ..... B65D 41/12 215/228
4,253,580 A * 3/1981 Doi ..... B65D 53/00 215/228
4,310,100 A * 1/1982 Kunimoto ..... B65D 53/00 215/228
4,379,512 A * 4/1983 Ohmi ..... B65D 41/0435 215/327
4,464,109 A * 8/1984 Giangiulio ..... F21S 13/00 220/613
4,561,555 A * 12/1985 Miller ..... B29C 49/4278 215/327
4,562,685 A * 1/1986 Tomita ..... B67B 3/14 53/201
4,562,930 A * 1/1986 Lecinski, Jr. ..... B65D 41/0457 215/44
4,767,016 A * 8/1988 Cook, Jr. ..... B65D 51/20 215/230
4,813,557 A * 3/1989 Herron ..... B65D 41/348 215/329
4,947,627 A * 8/1990 Scheidegger ..... B65D 55/0854 53/290
5,269,429 A * 12/1993 Schumacher ..... B65D 51/002 215/249
5,373,683 A * 12/1994 Kronseder ..... B67B 3/02 53/267
5,457,943 A * 10/1995 Hertrampf ..... B65D 51/1661 53/331
5,514,442 A * 5/1996 Galda ..... B65D 51/20 215/232
5,555,988 A * 9/1996 Koch ..... B65D 51/002 215/249
5,802,812 A * 9/1998 Heudecker ..... B67C 3/222 53/287
6,006,933 A * 12/1999 Henning ..... B65D 41/12 215/326
6,478,174 B1 * 11/2002 Grazia ..... B65D 41/12 215/277
6,510,957 B2 * 1/2003 Gilley ..... B65D 39/0011 215/296
6,681,475 B2 * 1/2004 Thibault ..... A61J 1/1406 215/249
6,904,662 B2 * 6/2005 Thibault ..... A61J 1/1406 215/247
8,101,041 B2 * 1/2012 Foldesi, Jr. ..... B29C 70/80 156/308.4
8,424,706 B2 * 4/2013 Robertson ..... B65D 41/0442 215/317
8,757,408 B2 * 6/2014 Joubert ..... B65D 23/085 215/227
9,457,938 B1 * 10/2016 Gilliam ..... B65D 41/02
9,499,312 B1 * 11/2016 Gilliam ..... B65D 41/34
2005/0204710 A1 * 9/2005 Denom ..... B67B 3/02 53/490
2008/0237238 A1 * 10/2008 Bloom ..... B65D 41/045 220/378

FOREIGN PATENT DOCUMENTS

| | | |
|---|---|---|
| DE | 4018121 | 12/1991 |
| DE | 4036306 | 6/1992 |
| DE | 102005004996 | 7/2006 |
| DE | 102014010626 | 5/2015 |

* cited by examiner $t_3 > t_2 > t_1$

FIG. 5
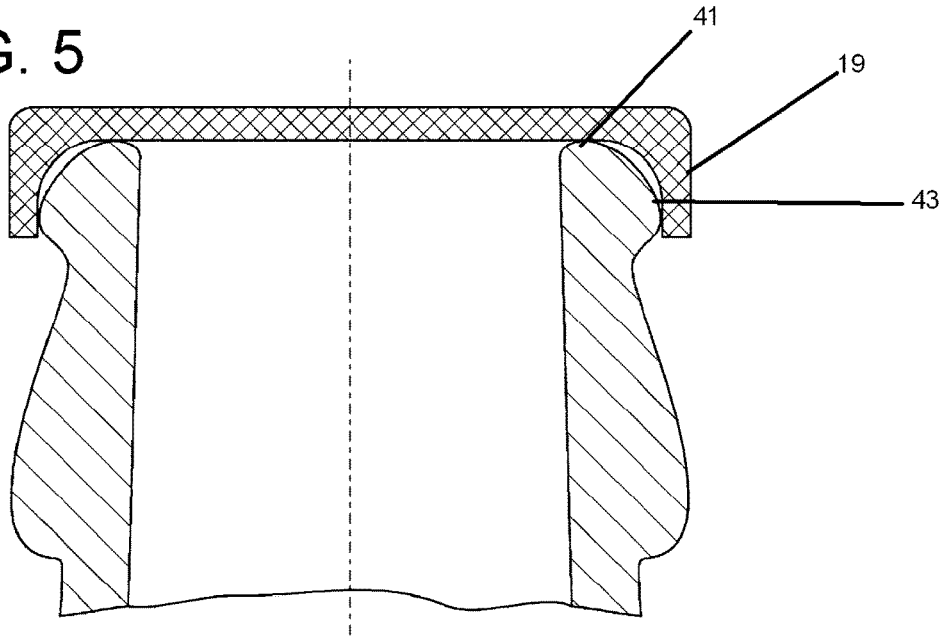
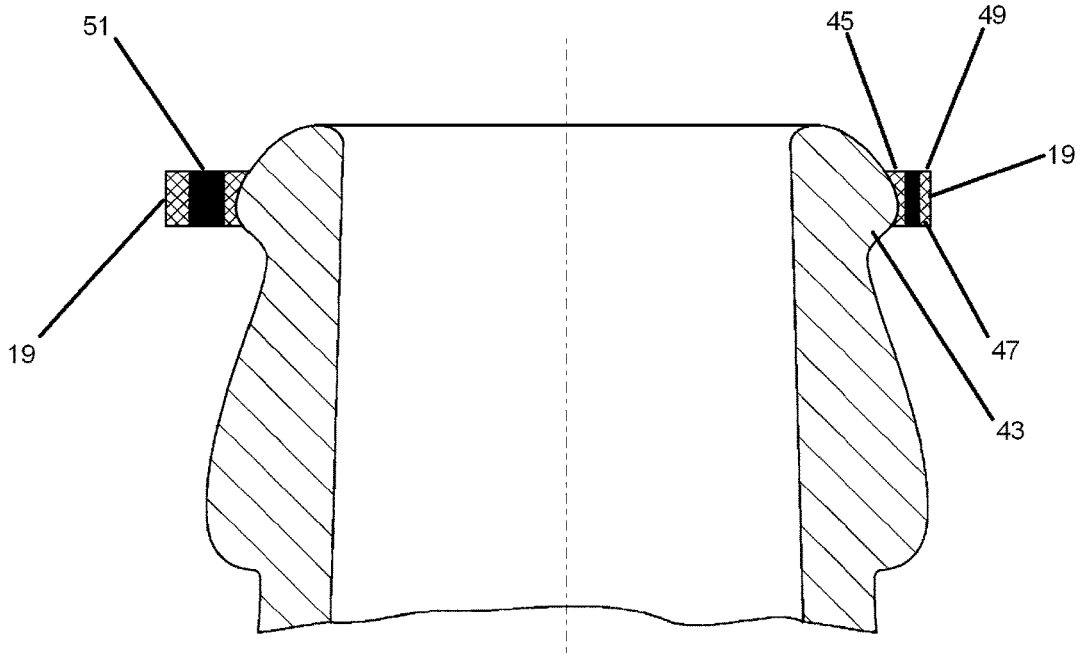
FIG. 6

CROWN CAP CLOSURE AND CLOSURE METHOD

CONTINUING APPLICATION DATA

This application is a Continuation-In-Part application of International Patent Application No. PCT/EP2015/056266, filed on Mar. 24, 2015, which claims priority from Federal Republic of Germany Patent Application No. 10 2014 104 323.5, filed on Mar. 27, 2014. International Patent Application No. PCT/EP2015/056266 was pending as of the filing date of this application. The United States was an elected state in International Patent Application No. PCT/EP2015/056266.

BACKGROUND

1. Technical Field

The present application relates to a crown cap closure and closure method.

2. Background Information

Background information is for informational purposes only and does not necessarily admit that subsequently mentioned information and publications are prior art.

The present application relates to a crown cap closure for containers, especially for bottles (glass bottles), and to a closure method.

Crown caps are very common and known as closures for containers, especially for drinks bottles made from glass, for example for beer and soft drink bottles. Crown caps comprise a circular piece of metal with a crown-like bent edge and a sealing inlay. The latter was originally made of cork which as a compressible intermediary provided the required and/or desired seal between the neck of the bottle and the metal. Polyvinyl chloride (PVC) or polyethylene (PE) are common today. Crown caps are also usually covered with protective lacquers to prevent, essentially prevent, restrict, and/or minimize corrosion.

The most common crown cap has twenty-one teeth, the advantage of the odd number of teeth being that they are not directly opposite one another and so avoid, restrict, and/or minimize tilting in conveyor units.

Crown caps are fitted to the containers by way of a closure machine which guides conveyed crown caps with the aid of, for example, a magnetic punch and presses them down onto the neck of the bottle. At the same time a cylindrical region lowers down around the crown cap to essentially ensure and/or promote that the toothed edge is bent over or crimped around the container's mouth region.

Some methods for closing containers may include and/or utilize crown caps that are closed onto the mouth end of a container while forming a sealing force-fit between the closure element and the container, with a provisional clamped connection being produced in a first closure phase and the final sealing force-fit being produced in a subsequent closure phase. The provisional clamped connection of the closure element to the container is produced by the plastic deformation of the crown cap. Such closure operations may comprise multiple stages with different, i.e. increasing, closure forces. Some methods or apparatus may disclose a further crown cap sealer in which a crimping head is provided which comprises protruding pin elements that can move for crimping over the edge of the crown. A pneumatic driving device is provided to generate an advance movement for the crimping head.

Some possibly hygienic devices may involve the container being closed in a sterile space generated by an inert gas.

Although the method and the devices commonly used for it are in widespread use, there is a problem in that, during the filling operation immediately or essentially immediately or generally upstream of the sealer, the container mouth is often moistened with product which can then go moldy in the space created beneath the fitted and crimped crown cap teeth. In any event the spaces beneath the crown cap form a partially open cavity in which contamination cannot be avoided, restricted and/or minimized and with which the consumer's lips come into contact.

OBJECT OR OBJECTS

It is an object of the present application to provide a crown cap closure which offers enhanced hygienic properties.

SUMMARY

This object is achieved, according to the present application, with the crown cap system of the present application; a method for closing according to the present application is disclosed for carrying out the actual closing.

Such a cap-like closure system for containers is provided with crown caps comprising a plurality of jag-like or tooth-like shape ends. The latter are usually odd in number so as to avoid, restrict, and/or minimize blockages in the transport paths. These crown caps are composed at least partially of a metal and/or aluminum-containing material (main body) and can comprise an inner lining composed of one or more layers (rubber, plastic) for improving the seal between the container mouth and the underside of the crown cap. The crown cap is shaped in such a way that following the intentional deformation which closes the mouth of the container, the shape ends assume the fundamentally familiar jagged or toothed radial contour such that one or more cavities are formed between the outer container surface that is close to the mouth, and the shape ends.

A deformable sealing material which closes the cavities, at least to the extent of the end that points to the base of the container, is provided in the region of the shape ends. The sealing material is a ring-like or hoop-like element which is separate from the crown cap and is attached in the corresponding mouth region of the container separately from, i.e. independently of, the main body of the crown cap, but then interacts with the crown cap (main body) in such a way that when the shape ends of the crown cap are deformed for the final container closure they press or sink into the sealing material at least in some sections.

The sealing material can be a rubber-like or foam-like material, in one possible exemplification a rubber-like or foam-like material whose outer surface compared with its inner surface is devoid or essentially devoid of pores, so hindering the accumulation of impurities. A germ-destroying or growth-inhibiting material such as silver, zinc or copper particles or other permitted substances can be added to the sealing material.

In at least one possible exemplification the sealing material is configured as a disc-like or plate-like molding in the manner of a sealing pad which has two more or less concentric regions. The one region is the radially outer region (edge region) which is configured as a bead-like ring contour or sealing contour. This can be suitably contoured to match the shape ends, i.e. can also comprise a tooth-like structure. The inner region forms the flatter center section which constitutes the mouth seal at the top of the container. If required and/or desired this center section can comprise a support or contouring which matches the container mouth, as a mouth seal.

In a first step, the sealing pad can be connected to the upper and lateral container mouth/surface or attached to these (before the application of the crown cap and closure of the container), in such a way that the sealing pad is in contact over its whole area, i.e. it is fixed in position. Alternatively, provision can be made for part of the surface of the inner and/or outer region to be fixed in position on the container mouth, the result being that a stretching or movement in the material of the sealing pad is easily possible in order to achieve an optimum seal.

It is possible for a sealing material to be used which in regard to volume can be activated. In this case the crown cap which is provided with a minimal volume of sealing material can be stored and transported as loose stock to save space and in at least one possible exemplification without damaging the softer sealing material. The desired increase in volume to close the unwanted cavities is effected after the mechanical deformation of the crown caps and the closure of the containers. Alternatively, however, this activation and increase can also be effected in the path of the crown cap as it is fed to the container if the latter is already available in an at least partially definite position and/or orientation. The cap-like closure system according to the present application wherein the sealing material can be activated by an input of energy, in at least one possible exemplification thermal energy, in that it expands under the influence of heat.

The activation is achieved in at least one possible exemplification through the input of thermal energy in that the sealing material expands under the influence of heat. The main body of the crown cap can be heated up through contact heating, radiantly or inductively so that the sealing material is indirectly heated up by way of thermal conduction.

Since glass bottles in at least one possible exemplification are cold from the filled product after filling, usually in a temperature range below fifteen degrees Celsius, in at least one possible exemplification below ten degrees Celsius, it may be possible for the heat to be introduced into the material of the crown cap vertically or essentially vertically from above in a very limited region, namely the section which covers the container's mouth opening, so no or only a very minimal amount or a small amount of heat is introduced into the surface of the container, in at least one possible exemplification the sealing material also acting as thermal insulation.

Alternatively the sealing material can have a so-called "memory" effect by which, after pressure is removed, a compressed, reduced volume form is retained for a while and/or the original, enlarged volume form is slowly restored. The reduction in volume can be effected in that the sealing material of the crown caps is briefly compressed in the feed line to the container or in that the crown caps and sealing material are stored under pressure or compression such that the reduction in volume is already present in the sorting and feeding system to the closer or container. Mention here can be made of materials made from a polyurethane or from materials containing polyurethane, for example. As stated above, the reverse forming process can also be assisted or accelerated by way of energy input in a comparable manner.

A further possible exemplification comprises in the sealing material being one or more coats of a hot-melt adhesive which after the deformation and closure is then at least partially melted by a suitable input of energy. To this end a hot-melt adhesive in at least one possible exemplification can be provided which prior to the aforesaid heating is softer and more elastic than after melting (embrittlement, curing) so that opening the crown cap or container produces a kind of fracture in the adhesive which can easily be seen, especially by the consumer. The shape end of the main body can sink into the still soft hot-melt adhesive which was applied in liquid form, and the hot-melt adhesive can subsequently cool down and harden. Alternatively the hot-melt adhesive can be fed in a collar or ring form (hard), folded over and then melted in certain regions as required and/or desired.

An exemplification of the cap-like closure system of the afore-mentioned variants is achieved in that the sealing material projects radially out over the shape ends and that this freely projecting sealing material forms a kind of retaining ring or collar which when the container is opened is compromised because it has to be or can be partially distorted, broken and/or split, for example. Consequently the sealing material also acts as a safeguard against tampering and as proof of hygiene.

The sealing material can also be influenced, at least in a certain region, i.e. within a limited space, in such a way that it hardens or embrittles more strongly in that region or as a whole. Such an influence can be brought about if required and/or desired by way of UV radiation, an additional input of energy, cold shock or other suitable manner.

In one variant the sealing material contains, for example, components which can be cured by ultraviolet (UV). In this case there is a chemical reaction due to UV polymerization during curing. The sealing material, if possible, in its edge region, comprises photo initiators which in their initial form exist in a double bond. If UV radiation is now applied using emitters, the photo initiators are activated and the energy-rich UV radiation breaks up the double bond of the photo initiators with the result that free radicals form and an irreversible cross-linking to macromolecules takes place with for example filling and bonding agents. This in turn results in curing and embrittlement.

Consequently a method is provided for closing containers with a cap-like closure system according to any one of the preceding exemplifications, in which the step in which the shape ends are deformed is followed by a reverse formation step and/or an activation step in which an at least temporary alteration in the shape and/or state of the sealing material is brought about by reducing pressure or indirectly by applying energy to the crown caps or directly by applying energy to exposed areas of the sealing material. This is usually an increase in the volume of the sealing material in which the cavities are closed. In at least one possible exemplification, in one step the deformable sealing material is applied to the container surface in the mouth or neck region, and in a subsequent step the deformation of the shape ends of the crown cap (main body) is carried out.

In the first step, the sealing material is applied or attached in the mouth region of the container as a ring or collar, and in a subsequent step the crown cap is placed onto the mouth and then deformed. The sealing material is placed in an axial position such that the free ends of the form ends which point to the base of the container lie in the sealing material or form an edge or ridge together with it. In the event of a liquid application of hot-melt adhesive, this can also be carried out after the initial placing (adhering) of the main body.

After the deformation the projecting sealing material (after activation) advantageously forms a ring or collar underneath the free shape ends which radially covers the free shape ends. After the deformation, the projecting sealing material is chemically and/or physically cured and/or embrittled in a subsequent step.

If, after the deformation and activation of the sealing material, the sealing material projects axially outward with a ring-like or collar-like region the free shape ends, the projecting free sealing material can, by activation and/or by an additional treatment step, be enlarged in at least one possible exemplification in the radial direction so that it covers the edges of the crown cap which point axially downward, so forming a ring or collar beneath the free shape ends which may have the same or a greater outer circumference than the greatest outer circumference of the shape ends in the deformed closure condition.

Thus a device is also provided for closing containers with a cap-like closure system according to one of the aforementioned exemplifications which comprises at least one container inlet, at least one closure tool and at least one crown cap feeder, and a container outlet, with one or a plurality of sealing material feeders and sealing material application units being provided.

A curing and/or embrittling unit may be provided in at least one possible exemplification downstream of the closer position or closer unit, although it can also be an integral part of the closer station and be activated, i.e. switched on, as and when required and/or desired.

The container closer in at least one possible exemplification may be a rotary-type closer having a plurality of closer stations each comprising at least one closure tool.

Suitably arranged items of equipment such as heaters, emitters, compressors etc. are provided for the machine-related implementation of the aforesaid exemplifications.

Suitable laser and/or lens systems may be provided in at least one possible exemplification for the heating or irradiation which may be very small in surface area.

High-energy lasers which are directed obliquely from below onto free surfaces of the adhesive coating and/or which are directed radially at that region of the shape ends beneath which the adhesive coating is arranged, are suitable and in at least one possible exemplification for melting a hot-melt adhesive after the container is closed.

The other known process steps upstream and downstream of the container closer can be analogously combined accordingly to suit requirements and/or desires. These are suitable test and inspection units upstream and downstream of the closer, cleaning and disinfecting units to vacuum-extract impurities and if possible to sterilize the closures. In at least one possible exemplification, a closure inspection element which checks the proper quality of the closure and the presence of the crown cap and any produced retaining rings under the crown cap may be provided downstream of the closer.

Some units which transport the closures to the closer and take account of and determine alignment and position act as feed systems. The desired directional orientation is retained in such a transport unit. The crown caps are also transferred to the closer via pick & place station(s), a blow-in device or other suitable elements.

If desired, a mouth spray can be provided upstream of the actual closure step to wash away foam residues for example.

The closer itself comprises known closure heads capable of applying the described crown caps.

In at least one possible exemplification the sealing material is executed as a sleeve-like cap (seal cap) which is placed over the container mouth before the crown cap (main body) is fitted. In this way the actual mouth head area and part of the mouth's side wall and possibly neck area are covered by the seal cap. In at least one possible exemplification, this seal cap is widened out (stretched) before being applied to the container mouth and after the fitting and discharge of the feeder element assumes a force-fitting final position around the mouth. Alternatively or additionally the seal cap can be shrinkable by way of energy input (heat, radiation etc.) so that such a step for inputting energy is provided before or after the crown cap is deformed (closure).

In at least one possible exemplification, the application of the crown cap (main body) to the seal cap produces a unit such that when the crown cap is mechanically opened by, say, the consumer, the seal cap is destroyed and in at least one possible exemplification is left behind on the main body of the crown cap, is therefore loosened and removed with the latter during the intended opening process. In order to produce this connection between crown cap (main body) and seal cap, suitable bonding media or hot-melt adhesives, vulcanisable materials etc. can be applied and, if desired, activated (e.g. hot-melt glue) as part of the method and/or be already applied to the preforms and/or be an inherent part of the material properties.

Suitable perforation in the sealing sleeve, in at least one possible exemplification one or a plurality of perforations running vertically or substantially vertically, can improve the opening characteristics.

The above-discussed exemplifications of the present invention will be described further herein below. When the word "invention" or "exemplification of the invention" is used in this specification, the word "invention" or "exemplification of the invention" includes "inventions" or "exemplifications of the invention", that is the plural of "invention" or "exemplification of the invention". By stating "invention" or "exemplification of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

FIG. 5 shows another exemplification of sealing material;

FIG. 6 shows another possible exemplification of sealing material comprising coats;

DESCRIPTION OF EXEMPLIFICATION OR EXEMPLIFICATIONS

Figure 1A:
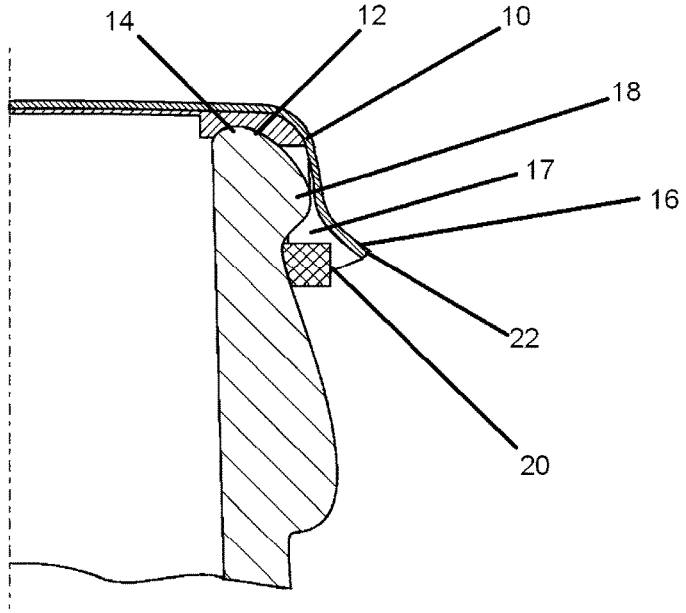
FIG. 1A shows an exemplification with the cap-like closing system installed on a bottle.

FIG. 1A shows an exemplification with the cap-like closing system installed on a bottle. The system comprises a metal crown cap 10 with an upper seal 12 disposed between the metal crown cap 10 and the extreme upper mouth of the bottle 14 with the jagged or tooth-shaped ends 16 of the crown cap 10 pressed against the bottom portion 18 of the bottom portion of the furthest upward extending portion of the bottle 14.

A ring or ring element projects in the axial direction downwardly at the extreme end 22, which points downwardly, of the crown cap 10. The ring 20 is tensioned by the free lower edges 22 of the jagged or tooth-shaped ends 16.

The right-hand portion of the FIG. 1A shows the portion of the jagged or tooth-shaped shaped ends 16 which has not been collapsed by the closing of the bottle 14.

Figure 1B:
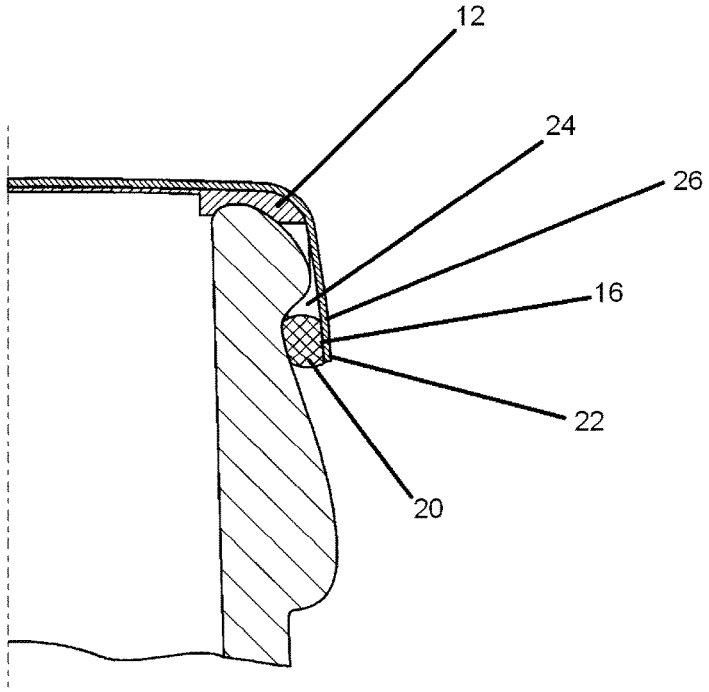
FIG. 1B shows the exemplification of FIG. 1A, in another sectional view, which shows the cap-like closing system installed.

FIG. 1B shows the exemplification of FIG. 1A, in another sectional view, which shows the cap-like closing system installed.

As can be seen, the right-hand of the bottle 14 with the crown cap 10 installed covers the open portion 16 (shown in FIG. 1A) of the jagged or tooth-shaped shaped ends 16. The right-hand portion of the FIG. 1B shows the portion of the jagged or tooth-shaped shaped ends 16 which has been collapsed by the closing of the bottle 14. The ring 20 as shown on the right-hand portion of the figure closes or seals the open portion 26.

A recess 24 is formed on the bottom portion of the ring or ring segments 20.

The exemplifications in FIGS. 1A and 1B show the regions of the jagged or tooth-shaped shaped ends 16, where a deformable sealing material 19 is provided, which closes the cavities 17 at least to the extent of the end that points toward the base of the container with the sealing material 19 forming a ring-like or hoop-like element 20 separate from the crown cap 10 and which interacts with the crown cap 10 in such a way that when the jagged or tooth-shaped shaped ends 16 are deformed for the container closure, the jagged or tooth-shaped shaped ends 16 press or sink into the sealing material 19.

Figure 2:
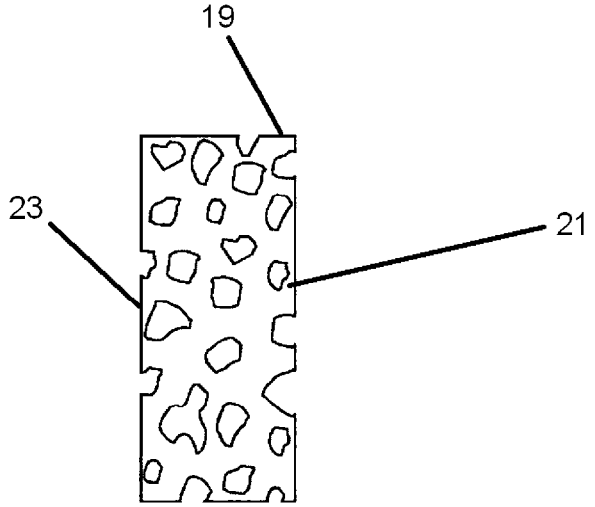
FIG. 2 shows one possible exemplification of sealing material.

As shown in FIG. 2, the sealing material 19 is a rubber-like or foam-like material 19, that is, a rubber-like or foam-life material 19 whose outer surface 21 compared with its inner surface 23 is devoid or essentially devoid of pores.

Alternatively, the pores could extend out of the outer surface 21 and inner surface 23 or only one of them such that at least one of the surfaces 21 and 23 are essentially devoid of pores.

Figure 3:
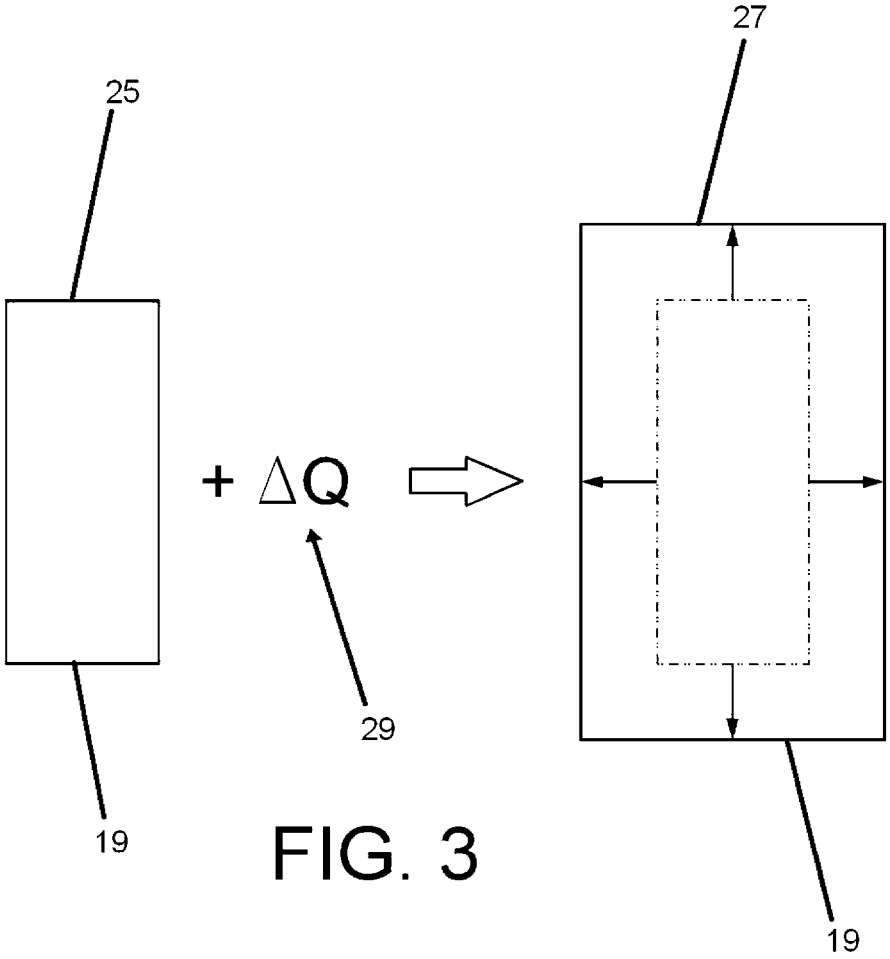
FIG. 3 shows activation of sealing material.

In FIG. 3, the sealing material 19 is a material that can be activated in regard to its volume. The original volume 25 is shown to the left in FIG. 3, and the expanded volume is shown as 27. Further, with regard to FIG. 3, the addition of energy shown as $\Delta Q$, shown as 29, indicates that the application of energy, such as a thermal energy, expands the original volume 25, under the influence of heat, to the volume 27.

Figure 4:
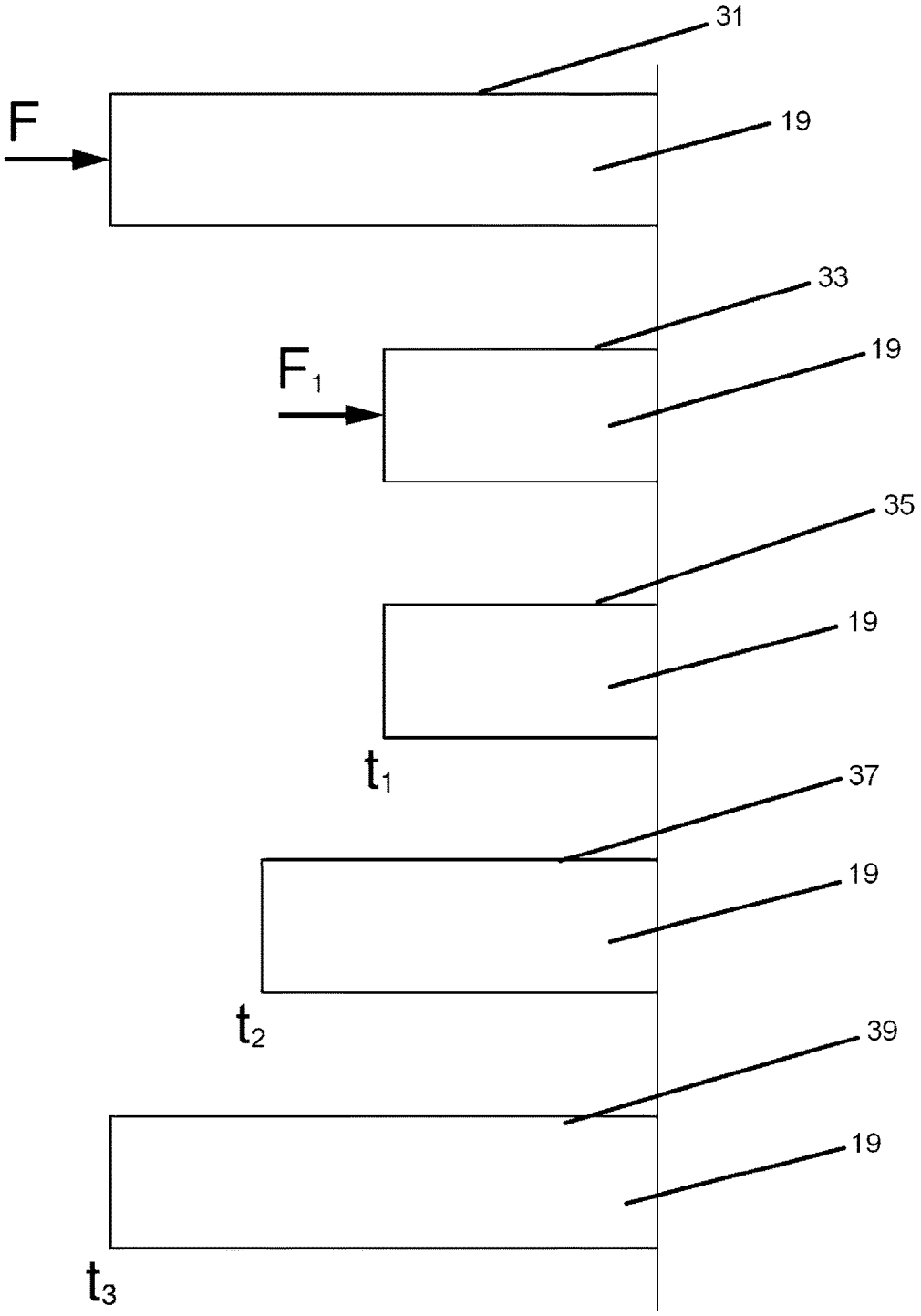
FIG. 4 shows memory effect sealing material.

FIG. 4 shows a memory effect material of which the sealing material 19 can be made. The original volume of the material 19 with a force F against the material 19 as shown in the left-hand portion of 31 initiates the reduction of the volume of the sealing material 19. Upon application of the force upon the sealing material 19 shown by the force $F_1$ as shown as 33 in FIG. 4, the volume of the sealing material 19 is reduced to a minimum for the sealing procedure. After a time, after the release of forces F and $F_1$, the sealing material 19 begins to expand as shown by the time $t_1$. The sealing material 19 as shown as 37 then expands after a time $t_2$, which is greater than time $t_1$, to a dimension that is greater than the dimension of 35.

Finally, after a time $t_3$, which is greater than time $t_2$, which was greater than time $t_1$, the sealing material 19 as shown as 39 expands to approximately or exactly the original volume of the sealing material shown in FIG. 4. Thus the memory effect, and after pressure is removed, retains a compressed, reduced volume form for a while and/or slowly loses it and aspires to the original, enlarged volume form again, as shown in 31.

FIG. 5 shows another exemplification in which the sealing material 19 and the upper seal 12 are in one piece and extend over the extreme upward portion of the bottle 14 down the sides of the mouth of the bottle 14 such that the sealing material 19 covers the actual mouth head area 41 and a part of the side of the mouth side wall 43.

FIG. 6 shows where the sealing material 19 comprises a plurality of coats of hot melt adhesive. These coats of sealing material 19 are shown as 45, 47, and 49. The coat 45 is the portion of the sealing material 19 which contacts the mouth side wall 43 of the bottle 14. The coat 47 is an intermediate layer between coats 45 and 49, and the coat 49 is an outer layer. Additionally, only one coat of hot melt adhesives could be used, rather than the three as shown.

The left-hand portion of FIG. 6 is shown with a thickened sealing material 19, which could be under one of the jagged or tooth-shaped shaped ends 16 disposed further away from the mouth side wall 43 of the bottle 14. The right-hand portion of FIG. 6 could be under one of the compressed jagged or tooth-shaped shaped ends 16.

In other words, the thickness of the sealing material 19 disposed around bottle 14 and between the bottle 14 and the crown cork 10 was originally a consistent and even thickness. The compression of the crown cap 10 around the bottle mouth area resulted in jagged edges 16 of the crown cork 10 compress the sealing material 19. The compressed portions of the crown cork 10 are therefore depressed further into the sealing material 19 than the tooth portions 16 of the crown cork 10, forcing the sealing material 19 to be compressed more beneath the compressed portions of the crown cork 10. The sealing material 19 between the bottle 14 and the jagged teeth 16 of the crown cork 10 is permitted to expand farther away from the bottle 14, and therefore appears to be thicker.

Figure 7:
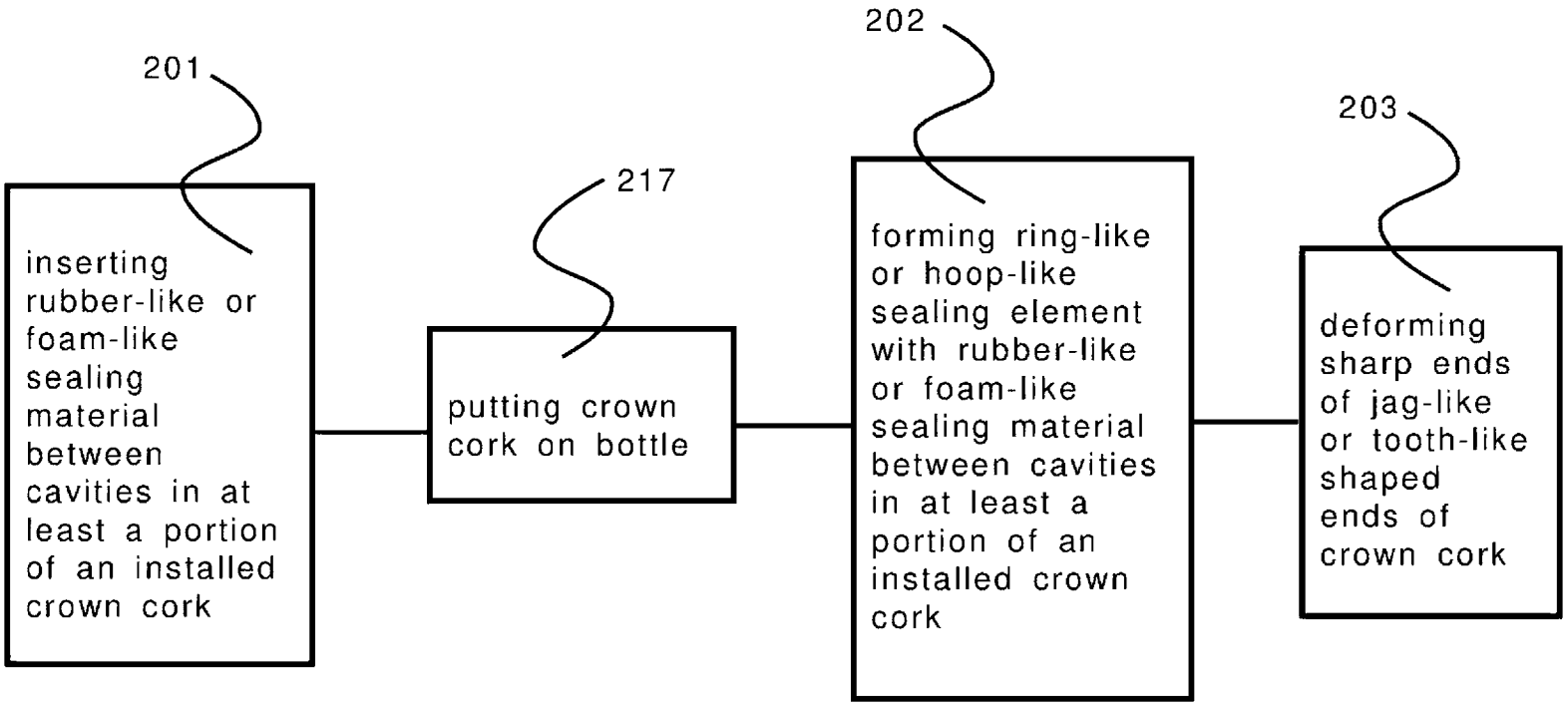
FIG. 7 is a box diagram showing one possible exemplification of a method according to the present application.

FIG. 7 shows a block diagram of one possible method according to the present application. A step in this method, as shown by 201, includes inserting rubber-like or foam-like sealing material between cavities in at least a portion of an installed crown cork. A following or subsequent step in the method as shown in FIG. 7, as shown by 217, includes putting crown cork on bottle. A following or subsequent step in the method as shown in FIG. 7, as shown by 202, includes forming ring-like or hoop-like sealing element with rubber-like or foam-like sealing material between cavities in at least a portion of an installed crown cork. A following or subsequent step in the method as shown in FIG. 7, as shown by 203, includes deforming sharp ends of jag-like or tooth-like shaped ends of crown cork.

Figure 8:
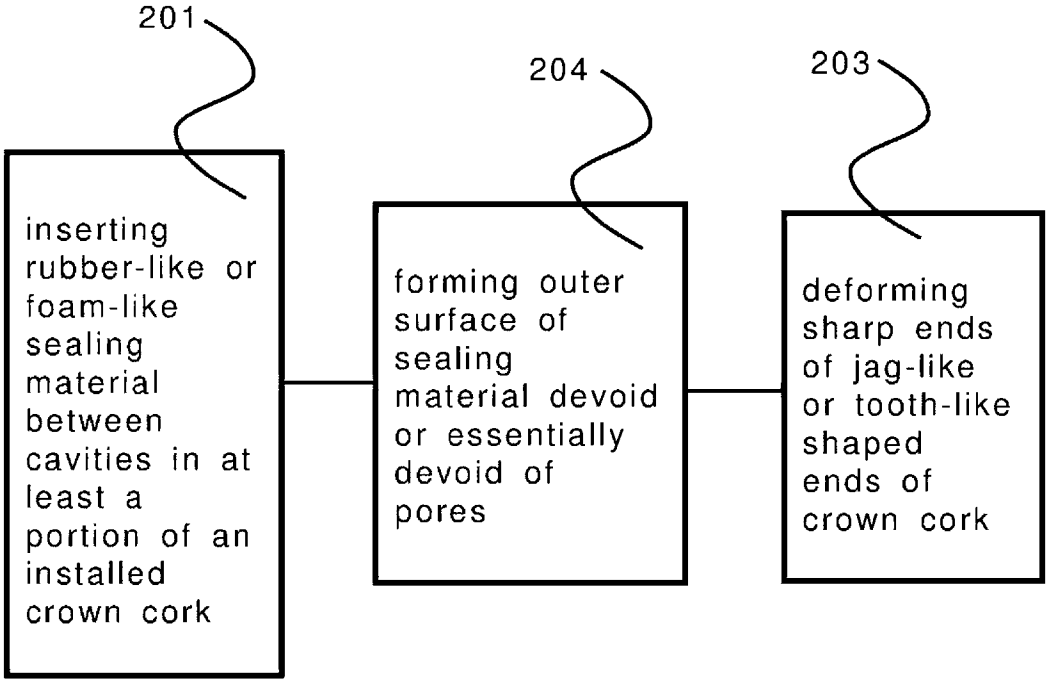
FIG. 8 is a box diagram showing one possible exemplification of a method according to the present application.

FIG. 8 shows a block diagram of one possible method according to the present application. A step in this method, as shown by 201, includes inserting rubber-like or foam-like sealing material between cavities in at least a portion of an installed crown cork. A following or subsequent step in the method as shown in FIG. 8, as shown by 204, includes forming outer surface of sealing material devoid or essentially devoid of pores. A following or subsequent step in the method as shown in FIG. 8, as shown by 203, includes deforming sharp ends of jag-like or tooth-like shaped ends of crown cork.

Figure 9:
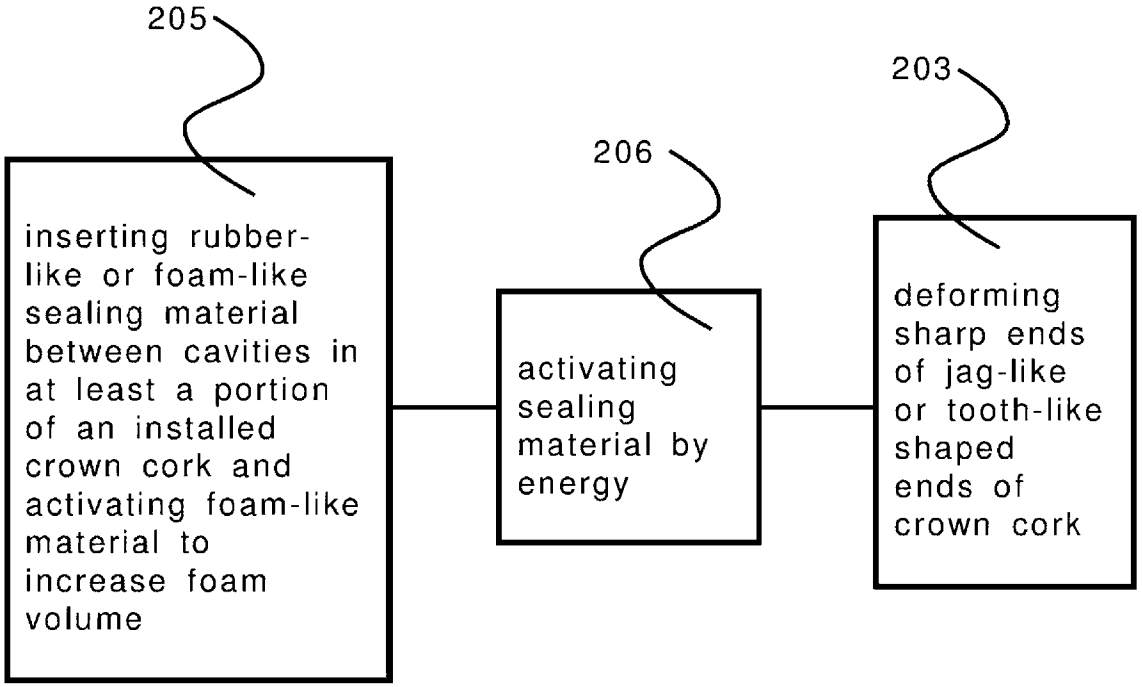
FIG. 9 is a box diagram showing one possible exemplification of a method according to the present application.

FIG. 9 shows a block diagram of one possible method according to the present application. A step in this method, as shown by 205, includes inserting rubber-like or foam-like sealing material between cavities in at least a portion of an installed crown cork and activating a foam-like material to increase foam volume. A following or subsequent step in the method as shown in FIG. 9, as shown by 206, includes activating sealing material by energy. A following or subsequent step in the method as shown in FIG. 9, as shown by 203, includes deforming sharp ends of jag-like or tooth-like shaped ends of crown cork.

Figure 10:
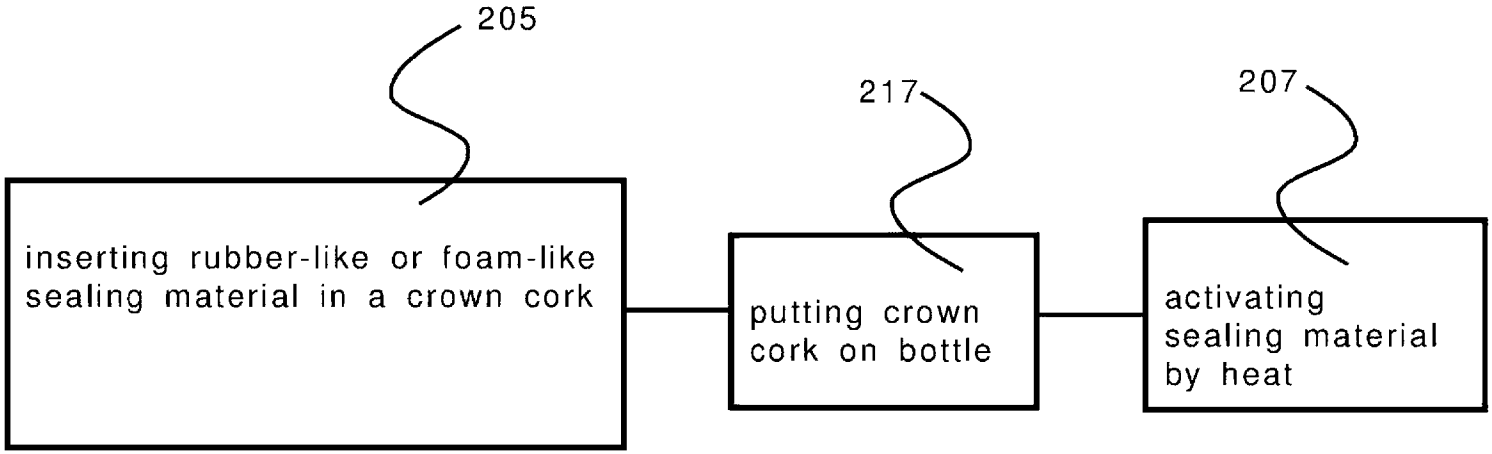
FIG. 10 is a box diagram showing one possible exemplification of a method according to the present application.

FIG. 10 shows a block diagram of one possible method according to the present application. A step in this method, as shown by 205, includes inserting rubber-like or foam-like sealing material between cavities in at least a portion of an installed crown cork and activating a foam-like material to increase foam volume. A following or subsequent step in the method as shown in FIG. 10, as shown by 217, includes putting crown cork on bottle. A following or subsequent step in the method as shown in FIG. 10, as shown by 207, includes activating sealing material by heat.

Figure 11:
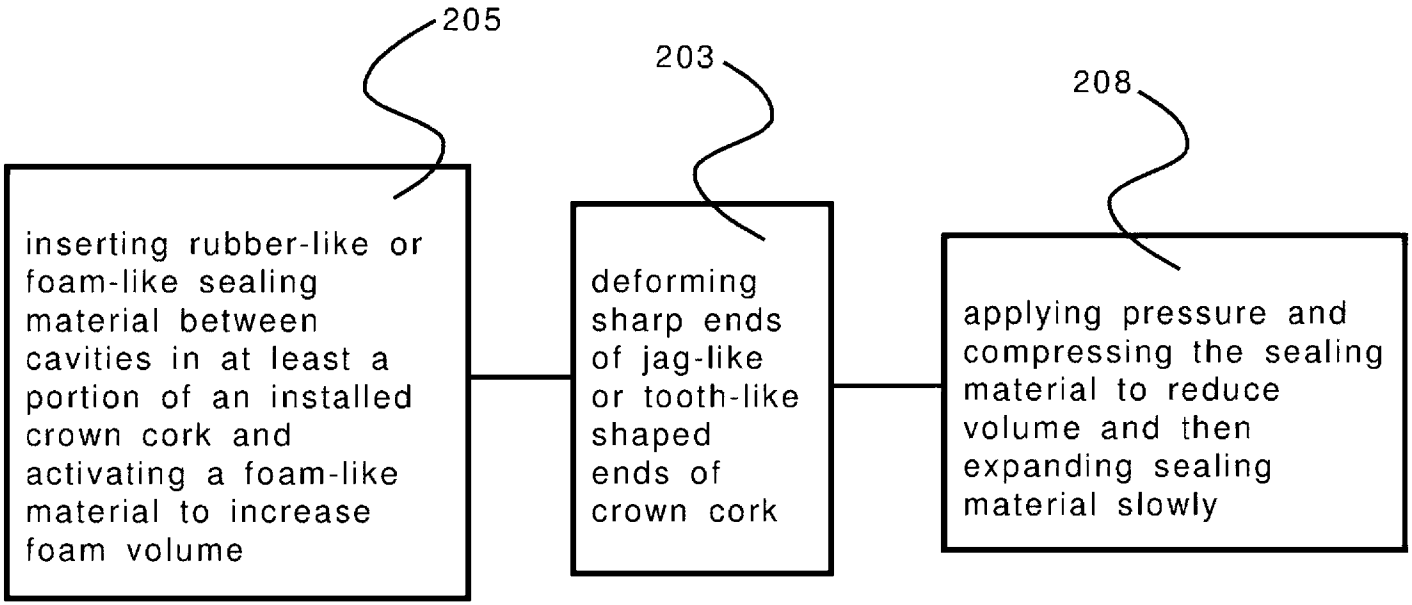
FIG. 11 is a box diagram showing one possible exemplification of a method according to the present application.

FIG. 11 shows a block diagram of one possible method according to the present application. A step in this method, as shown by 205, includes inserting rubber-like or foam-like sealing material between cavities in at least a portion of an installed crown cork and activating a foam-like material to increase foam volume. A following or subsequent step in the method as shown in FIG. 11, as shown by 203, includes deforming sharp ends of jag-like or tooth-like shaped ends of crown cork. A following or subsequent step in the method as shown in FIG. 11, as shown by 208, includes applying pressure and compressing the sealing material to reduce volume and then expanding sealing material slowly.

Figure 12:
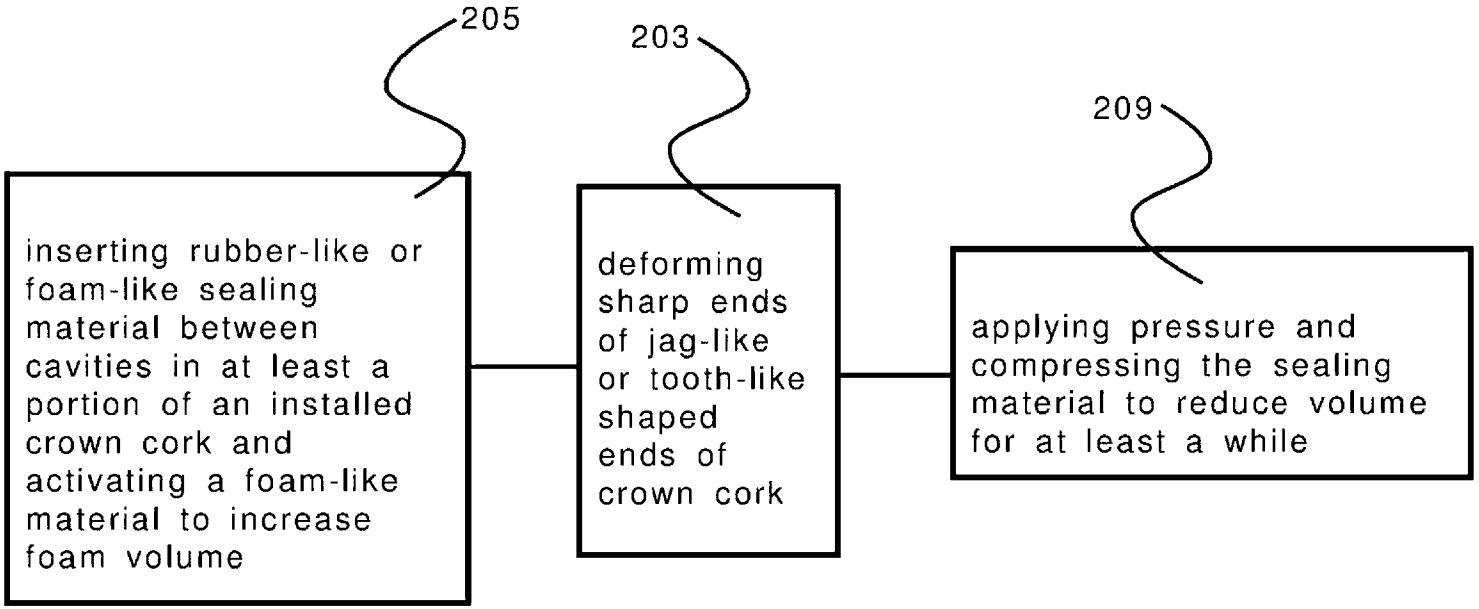
FIG. 12 is a box diagram showing one possible exemplification of a method according to the present application.

FIG. 12 shows a block diagram of one possible method according to the present application. A step in this method, as shown by 205, includes inserting rubber-like or foam-like sealing material between cavities in at least a portion of an installed crown cork and activating a foam-like material to increase foam volume. A following or subsequent step in the method as shown in FIG. 12, as shown by 203, includes deforming sharp ends of jag-like or tooth-like shaped ends of crown cork. A following or subsequent step in the method as shown in FIG. 12, as shown in 209, includes applying pressure and compressing the sealing material to reduce volume for at least a while.

Figure 13:
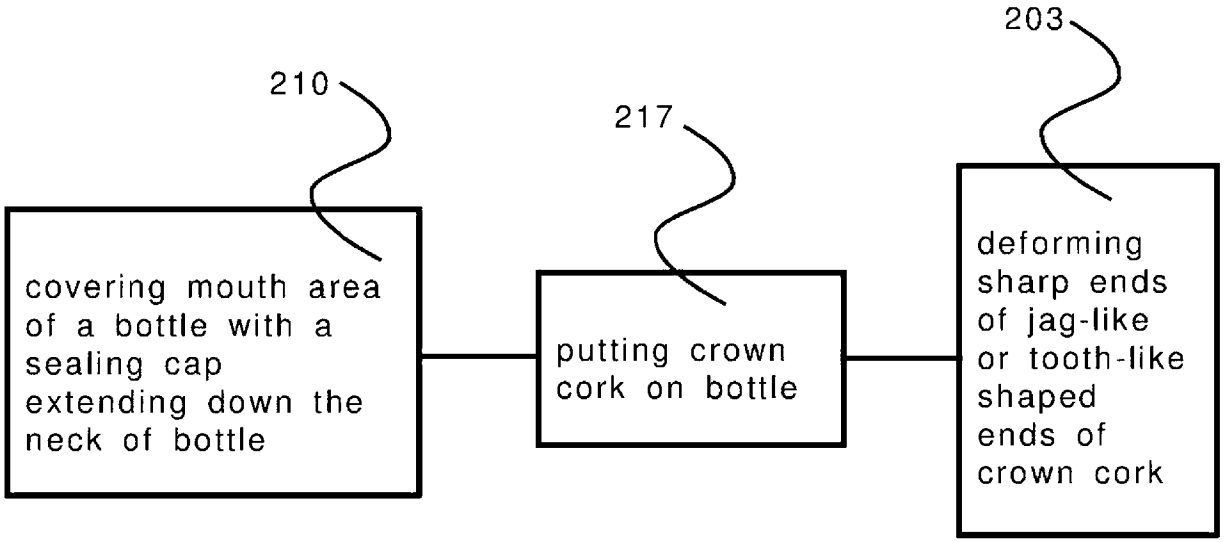
FIG. 13 is a box diagram showing one possible exemplification of a method according to the present application.

FIG. 13 shows a block diagram of one possible method according to the present application. A step in this method, as shown by 210, includes covering mouth area of a bottle with a sealing cap extending down the neck of bottle. A following or subsequent step in the method as shown in FIG. 13, as shown by 217, includes putting crown cork on bottle. A following or subsequent step in the method as shown in FIG. 13, as shown by 203, includes deforming sharp ends of jag-like or tooth-like shaped ends of crown cork.

Figure 14:
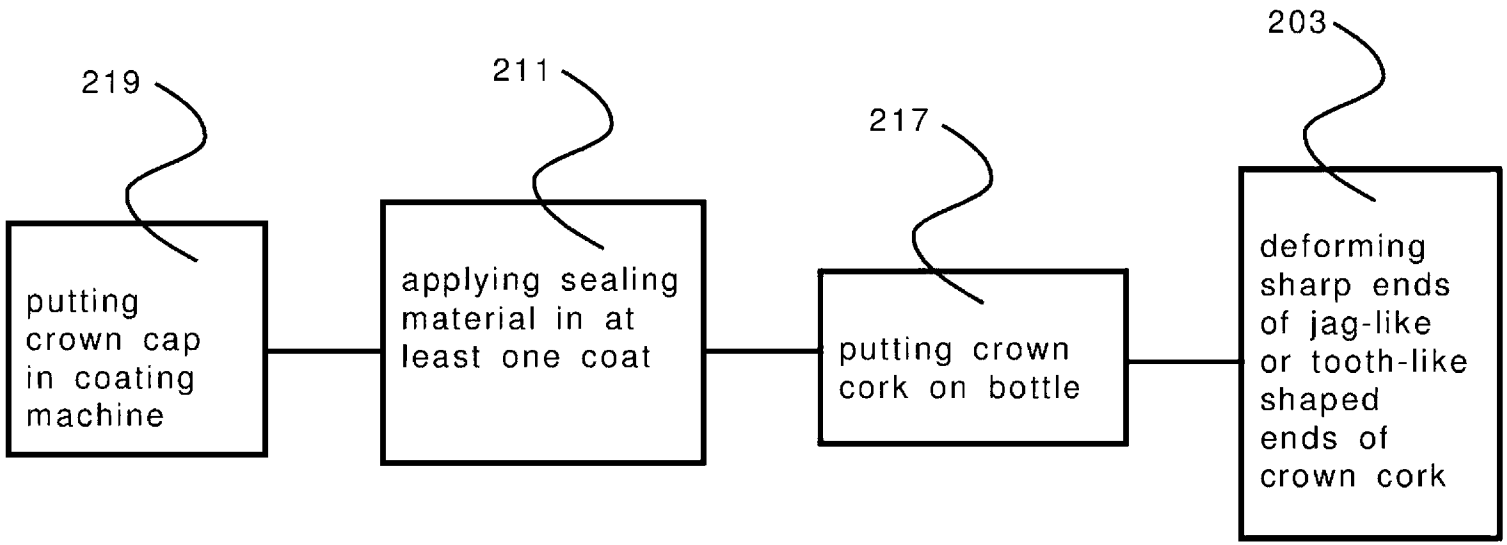
FIG. 14 is a box diagram showing one possible exemplification of a method according to the present application.

FIG. 14 shows a block diagram of one possible method according to the present application. A step in this method, as shown by 219, includes putting a crown cap in a coating machine. A following or subsequent step in the method as shown in FIG. 14, as shown by 211, includes applying sealing material in at least one coat. A following or subsequent A following or subsequent step in the method as shown in FIG. 14, as shown by 217, includes putting crown cork on bottle. A following or subsequent step in the method as shown in FIG. 14, as shown by 203, includes deforming sharp ends of jag-like or tooth-like shaped ends of crown cork.

Figure 15:
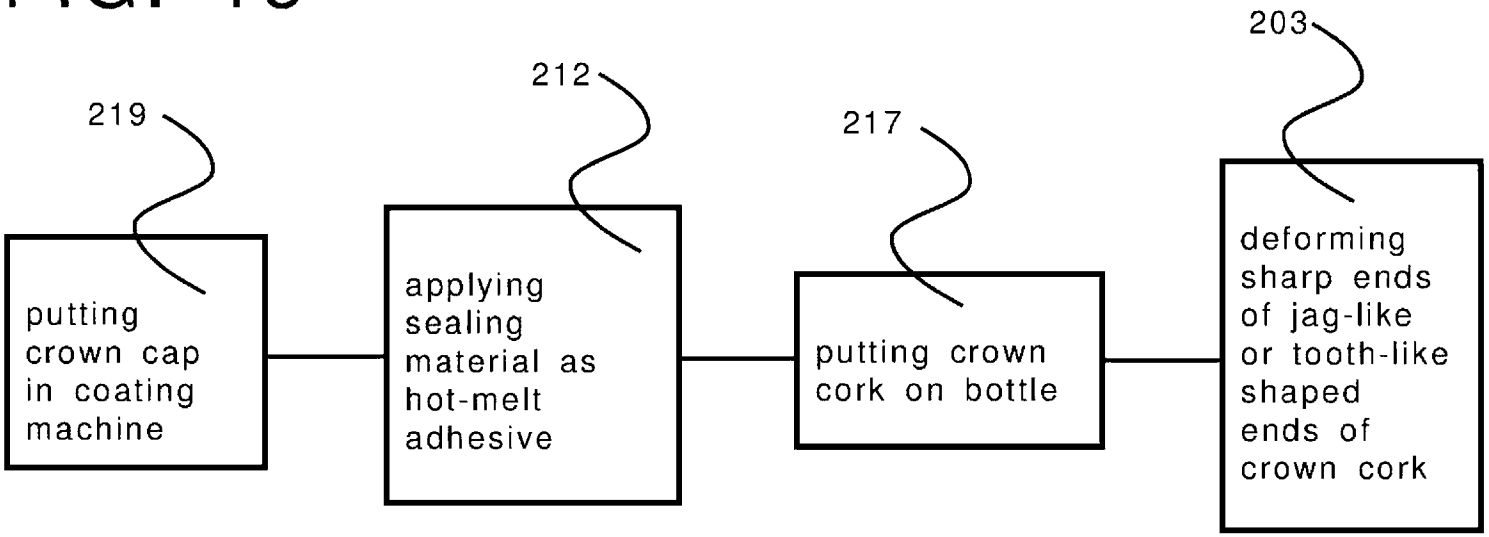
FIG. 15 is a box diagram showing one possible exemplification of a method according to the present application.

FIG. 15 shows a block diagram of one possible method according to the present application. A step in this method, as shown by 219, includes putting a crown cap in a coating machine. A following or subsequent step in the method as shown in FIG. 15, as shown by 212, includes applying sealing material as hot-melt adhesive. A following or subsequent A following or subsequent step in the method as shown in FIG. 15, as shown by 217, includes putting crown cork on bottle. A following or subsequent step in the method as shown in FIG. 15, as shown by 203, includes deforming sharp ends of jag-like or tooth-like shaped ends of crown cork.

Figure 16:
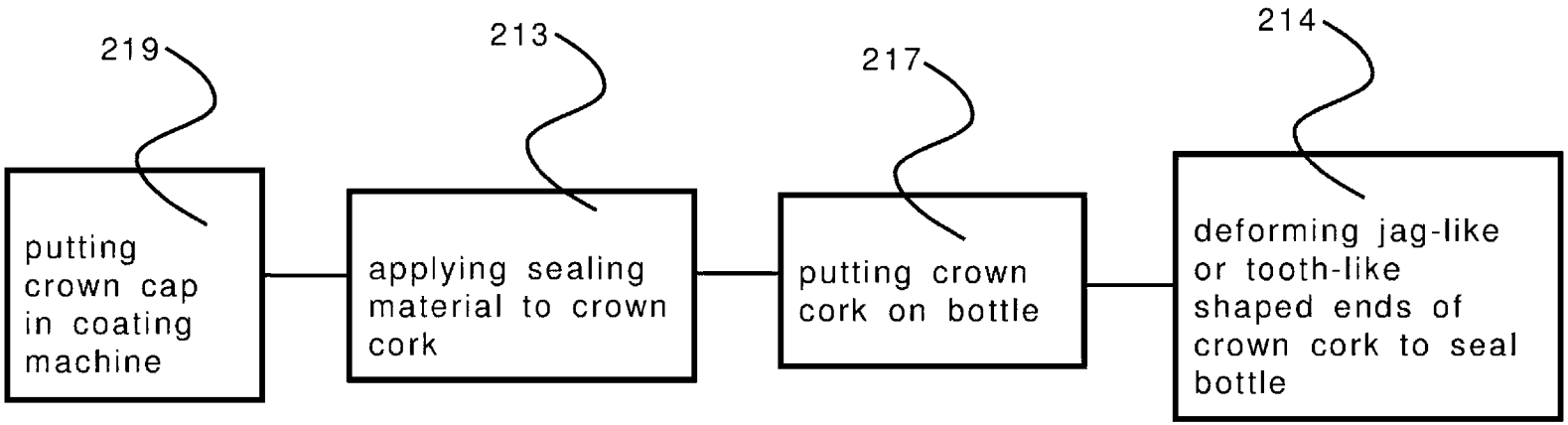
FIG. 16 is a box diagram showing one possible exemplification of a method according to the present application.

FIG. 16 shows a block diagram of one possible method according to the present application. A step in this method, as shown by 219, includes putting a crown cap in a coating machine. A following or subsequent step in the method as shown in FIG. 16, as shown by 213, includes applying sealing material to crown cork. A following or subsequent step in the method as shown in FIG. 16, as shown by 214, includes deforming jag-like or tooth-like shaped ends of crown cork to seal bottle. A following or subsequent step in the method as shown in FIG. 16, as shown by 203, includes deforming sharp ends of jag-like or tooth-like shaped ends of crown cork.

Figure 17:
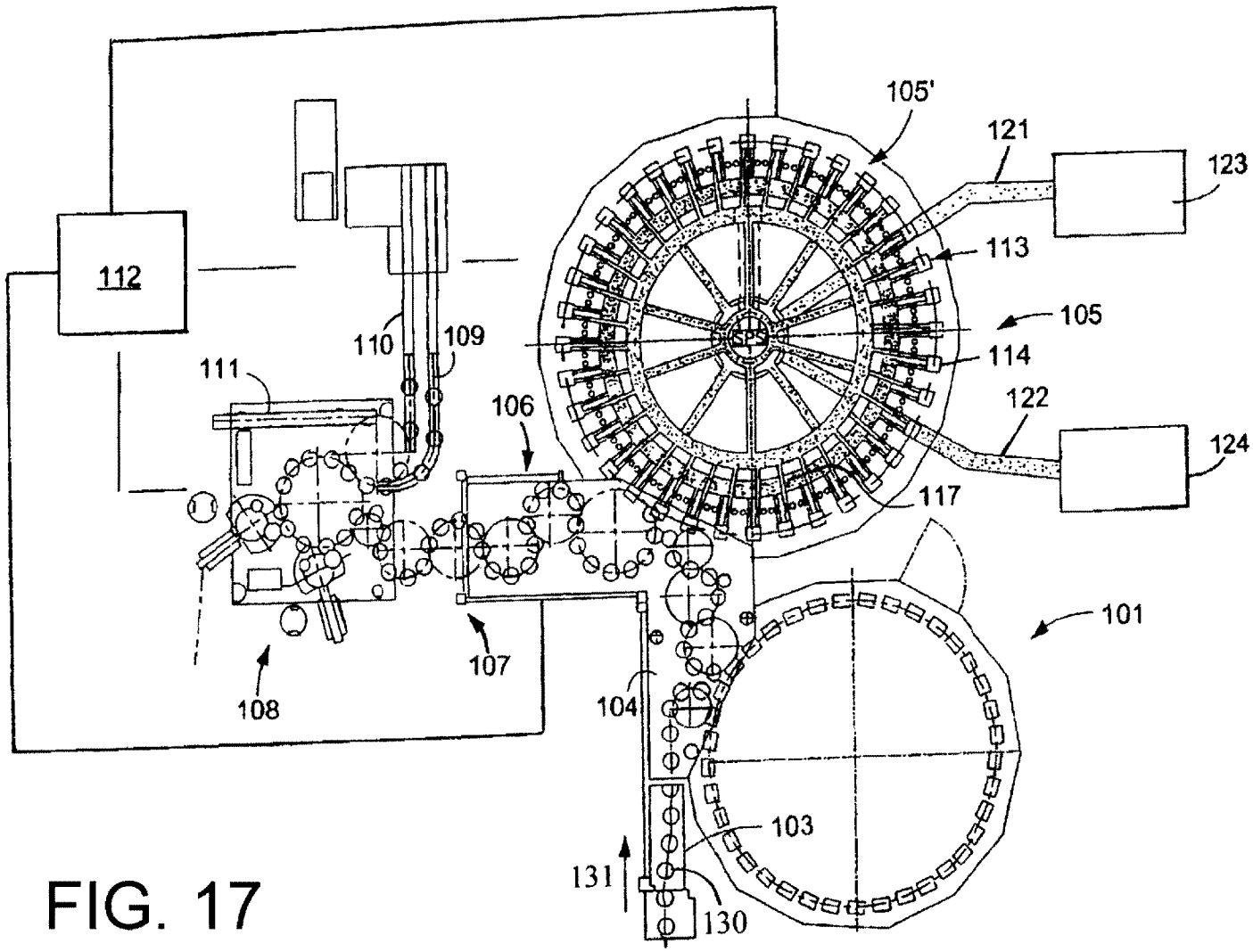
FIG. 17 shows schematically the main components of one possible embodiment example of a system for filling containers.

FIG. 17 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 17 shows a rinsing arrangement or rinsing station 101, to which the containers, namely bottles 130, are fed in the direction of travel as indicated by the arrow 131, by a first conveyor arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyor arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 17, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyor arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyor structure to three output conveyor arrangements: a first output conveyor arrangement 109, a second output conveyor arrangement 110, and a third output conveyor arrangement 111, all of which convey filled, closed, and labeled bottles 130 to different locations.

The first output conveyor arrangement 109, in the embodiment shown, is designed to convey bottles 130 that are filled with a first type of liquid beverage supplied by, for example, the supply reservoir 123. The second output conveyor arrangement 110, in the embodiment shown, is designed to convey bottles 130 that are filled with a second type of liquid beverage supplied by, for example, the supply reservoir 124. The third output conveyor arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyor arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The present application relates to a cap-like closure system for containers, in the form of crown caps, which have a plurality of jag- or tooth-like shape ends. The crown caps are composed at least partially of a metal and/or aluminum-containing material (main body) and can comprise an inner coating composed of one or more layers (rubber, plastic) for improving the sealing between the container opening and the underside of the crown cap. The crown cap is shaped in such a way that the shape ends have the fundamentally known corrugated or jagged radial contour after the intended deformation which closes the opening of the container, such that one or more cavities are formed between the outer container surface close to the opening and the shape ends. A deformable sealing material is provided in the region of the shape ends. The sealing material closes the cavities at least in the periphery of the end pointing toward the container bottom. The sealing material is a ring- or hoop-like element, which is separate from the crown cap and is attached in the corresponding opening region of the container separately from, i.e., independently of, the main body of the crown cap. However, the element then interacts with the crown cap (main body) in such a way that, when the shape ends of the crown cap are deformed for the final container closure, the form ends press or sink into the sealing material at least in some sections.

One feature or aspect of an exemplification is believed at the time of the filing of this patent application to possibly reside broadly in a cap-like closure system for containers, comprising a plurality of crown caps comprising jag-like or tooth-like shaped ends, which is formed at least in part by a metal and/or aluminum-containing material, with the crown cap being formed such that, after the intended deformation of the crown cap, which (deformation) seals the container, the shaped ends of one or a plurality of cavities is formed between the outer container surface and the shaped ends, wherein in the region of the shaped ends a deformable sealing material is provided which closes the cavities at least to the extent of the end that points to the base of the container, with the sealing material forming a ring-like or hoop-like element separate from the crown cap and which interacts with the crown cap in such a way that when the shaped ends are deformed for the container closure they press or sink into the sealing material.

Another feature or aspect of an exemplification is believed at the time of the filing of this patent application to possibly reside broadly in the cap-like closure system wherein the sealing material is a rubber-like or foam-like material, in at least one possible exemplification a rubber-like or foam-like material whose outer surface compared with its inner surface is devoid or essentially devoid of pores.

Yet another feature or aspect of an exemplification is believed at the time of the filing of this patent application to possibly reside broadly in the cap-like closure system wherein the sealing material is a material which can be activated in regard to its volume.

Still another feature or aspect of an exemplification is believed at the time of the filing of this patent application to possibly reside broadly in the cap-like closure system wherein the sealing material can be activated by an input of energy, in at least one possible exemplification thermal energy, in that it expands under the influence of heat.

A further feature or aspect of an exemplification is believed at the time of the filing of this patent application to possibly reside broadly in the cap-like closure system wherein the sealing material comprises a memory effect and after pressure is removed retains a compressed, reduced volume form for a while and/or slowly loses it and aspires to the original, enlarged volume form again.

Another feature or aspect of an exemplification is believed at the time of the filing of this patent application to possibly reside broadly in the cap-like closure system wherein the sealing material is a seal cap with which the actual mouth head area and a part of the mouth's side wall can be covered.

Yet another feature or aspect of an exemplification is believed at the time of the filing of this patent application to possibly reside broadly in the cap-like closure system wherein the sealing material is one or a plurality of coats of a hot-melt adhesive.

One feature or aspect of an exemplification is believed at the time of the filing of this patent application to possibly reside broadly in a method for closing containers with the cap-like closure system of the present application whereby the containers and the crown caps are fed to the closure device and wherein the deformable sealing material is applied in one step and the deformation of the shaped ends takes placed in a subsequent step.

Another feature or aspect of an exemplification is believed at the time of the filing of this patent application to possibly reside broadly in the method wherein the sealing material is applied as a ring or collar in the mouth region of the container in a first step and in a subsequent step the crown cap is placed on the mouth and then deformed, with the sealing material being placed in an axial position such that the free ends of the shaped ends pointing to the base of the container lie in the sealing material or form an edge or ridge together with it.

Yet another feature or aspect of an exemplification is believed at the time of the filing of this patent application to possibly reside broadly in the method wherein, after activation, the sealing material which projects after deformation radially covers the free shaped ends and forms a ring or collar beneath the free shaped ends.

Still another feature or aspect of an exemplification is believed at the time of the filing of this patent application to possibly reside broadly in the method wherein the sealing material which projects after deformation is chemically and/or physically cured and/or embrittled in a subsequent step.

A further feature or aspect of an exemplification is believed at the time of the filing of this patent application to possibly reside broadly in the method wherein the step in which the shaped ends are deformed is followed by an activation step in which energy is indirectly by applied to the crown caps or directly applied to exposed areas of the sealing material, bringing about an at least temporary alteration in the shape and/or state of the sealing material.

The components disclosed in the patents, patent applications, patent publications, and other documents disclosed or incorporated by reference herein, may possibly be used in possible exemplifications of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one exemplification of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various exemplifications may be used with at least one exemplification or all of the exemplifications, if more than one exemplification is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications, patent publications, and other documents cited herein, and in the Declaration attached hereto, are hereby incorporated by reference as if set forth in their entirety herein except for the exceptions indicated herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, patent applications, patent publications, and other documents which are included in this application and which are referred to in paragraphs which state "Some examples of . . . which may possibly be used in at least one possible exemplification of the present application . . . " may possibly not be used or usable in any one or more exemplifications of the application.

The sentence immediately above relates to patents, patent applications, patent publications, and other documents either incorporated by reference or not incorporated by reference.

U.S. patent application Ser. No. 15/277,382, filed on Sep. 27, 2016, having inventors Heinz HILLMANN and Andreas KRIEG, and title CROWN CORK CLOSURE AND CLOSING METHOD, and its corresponding Federal Republic of Germany Patent Application No. 10 2014 104 322.7, filed on Mar. 27, 2014, and International Patent Application No. PCT/EP2015/056264, filed on Mar. 24, 2015, having WIPO Publication No. WO 2015 144710 A1 and inventors Heinz HILLMANN and Andreas FAHLDIECK are hereby incorporated by reference as if set forth in their entirety herein.

U.S. patent application Ser. No. 15/277,360, filed on Sep. 27, 2016, having inventors Heinz HILLMANN and Andreas KRIEG, and title CROWN CAP AND CLOSING DEVICE, and its corresponding Federal Republic of Germany Patent Application No. 10 2014 104 316.2, filed on Mar. 27, 2014, and International Patent Application No. PCT/EP2015/056263, filed on Mar. 24, 2015, having WIPO Publication No. WO 2015/144709 A1—and inventors Heinz HILLMANN and Andreas FAHLDIECK are hereby incorporated by reference as if set forth in their entirety herein.

The following patents, patent applications, patent publications, and other documents, except for the exceptions indicated herein, are hereby incorporated by reference as if set forth in their entirety herein except for the exceptions indicated herein: DE 4018121 A1, having the English translation of the German title "Filling and closing bottles—involves mechanism which forms seal press seat between closure and bottle", published on Dec. 12, 1991; DE 1018121 A1, having the German title "Freiluft-Hochspannungsverbundisolator aus Kunststoff", published on Oct. 24, 1957; DE 4036306 A1, having the English translation of the German title "Fitting sealing caps to filled bottles", published on Jun. 4, 1992; and DE 35 15 334 A1, having the English translation of the German title "VESSEL CLOSING MACHINE", published on Oct. 30, 1986.

All of the patents, patent applications, patent publications, and other documents, except for the exceptions indicated herein, which were cited in the German Office Action dated Jul. 9, 2015, and/or cited elsewhere, as well as the German Office Action document itself, are hereby incorporated by reference as if set forth in their entirety herein except for the exceptions indicated herein, as follows: DE 10 2014 010 626 A1, having the German title "Verschluss einer Flasche mit einem Kronkorken", published on May 7, 2015; and DE 10 2005 004 996 B3, having the English translation of German title "Crown cap for bottles is produced by stamping from a metal sheet, with the seals laid in position, to give a base and a peripheral wall with a toothed structure", published on Jun. 20, 2006.

All of the patents, patent applications, patent publications, and other documents, except for the exceptions indicated herein, which were cited in the International Search Report dated May 29, 2015, and/or cited elsewhere, as well as the International Search Report document itself, are hereby incorporated by reference as if set forth in their entirety herein except for the exceptions indicated herein, as follows: U.S. Pat. No. 2,974,816, having the title "Closing and sealing bottles and other receptacles", published on Mar. 14, 1961.

The corresponding foreign and international patent publication applications, namely, Federal Republic of Germany Patent Application No. 10 2014 104 323.5, filed on Mar. 27, 2014, having inventors Heinz HILLMANN and Andreas KRIEG, and DE-OS 10 2014 104 323.5 and DE-PS 10 2014 104 323.5, and International Application No. PCT/EP2015/056266, filed on Mar. 24, 2015, having WIPO Publication No. WO 2015/144711 A1 and inventors Heinz HILLMANN and Andreas KRIEG, are hereby incorporated by reference as if set forth in their entirety herein, except for the exceptions indicated herein, for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications, patent publications, and other documents, except for the exceptions indicated herein, are hereby incorporated by reference as if set forth in their entirety herein except for the exceptions indicated herein.

The purpose of incorporating the corresponding foreign equivalent patent application(s), that is, PCT/EP2015/056266 and German Patent Application 10 2014 104 323.5, is solely for the purposes of providing a basis of correction of any wording in the pages of the present application, which may have been mistranslated or misinterpreted by the translator, and to provide additional information relating to technical features of one or more exemplifications, which information may not be completely disclosed in the wording in the pages of this application.

Statements made in the original foreign patent applications PCT/EP2015/056266 and DE 10 2014 104 323.5 from which this patent application claims priority which do not have to do with the correction of the translation in this patent application are not to be included in this patent application in the incorporation by reference.

Any statements about admissions of prior art in the original foreign patent applications PCT/EP2015/056266 and DE 10 2014 104 323.5 are not to be included in this patent application in the incorporation by reference, since the laws relating to prior art in non-U.S. Patent Offices and courts may be substantially different from the Patent Laws of the United States.

All of the references and documents cited in any of the patents, patent applications, patent publications, and other documents cited herein, except for the exceptions indicated herein, are hereby incorporated by reference as if set forth in their entirety herein except for the exceptions indicated herein. All of the patents, patent applications, patent publications, and other documents cited herein, referred to in the immediately preceding sentence, include all of the patents, patent applications, patent publications, and other documents cited anywhere in the present application.

Words relating to the opinions and judgments of the author of all patents, patent applications, patent publications, and other documents cited herein and not directly relating to the technical details of the description of the exemplifications therein are not incorporated by reference.

The words all, always, absolutely, consistently, preferably, guarantee, particularly, constantly, ensure, necessarily, immediately, endlessly, avoid, exactly, continually, expediently, ideal, need, must, only, perpetual, precise, perfect, require, requisite, simultaneous, total, unavoidable, and unnecessary, or words substantially equivalent to the above-mentioned words in this sentence, when not used to describe technical features of one or more exemplifications of the patents, patent applications, patent publications, and other documents, are not considered to be incorporated by reference herein for any of the patents, patent applications, patent publications, and other documents cited herein.

The description of the exemplification or exemplifications is believed, at the time of the filing of this patent application, to adequately describe the exemplification or exemplifications of this patent application. However, portions of the description of the exemplification or exemplifications may not be completely applicable to the claims as originally filed in this patent application, as amended during prosecution of this patent application, and as ultimately allowed in any patent issuing from this patent application. Therefore, any statements made relating to the exemplification or exemplifications are not intended to limit the claims in any manner and should not be interpreted as limiting the claims in any manner.

The details in the patents, patent applications, patent publications, and other documents cited herein may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the exemplification or exemplifications, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. § 1.72(b). As stated in 37 C.F.R. § 1.72(b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The exemplifications of the invention described herein above in the context of the preferred exemplifications are not to be taken as limiting the exemplifications of the invention to all of the provided details thereof, since modifications and variations thereof may be made without departing from the spirit and scope of the exemplifications of the invention.

What is claimed is:

1. A cap-like closure system for closing containers comprising:

a crown cap preform comprising a substantially flat, body portion and a corrugated, side portion disposed about and extending substantially radially from said flat body portion and ending in an exposed edge;

said body portion having a diameter sufficient to extend across and cover an opening in a mouth portion of a container;

said side portion comprising aluminum or similar deformable metal to permit deformation of said side portion onto an exterior side surface of a neck or mouth portion of a container to secure said crown cap preform onto a container to form a crown cap;

a ring-shaped seal being separated and disposed away from said crown cap preform and configured to be placed or formed onto and about a neck or mouth portion of a container prior to attachment of said crown cap preform;

said side portion comprising a plurality of teeth formed by alternating projections and indentations;

said teeth being disposed to project out such that spaces are formed within said projections and between said indentations;

said ring-shaped seal comprising a sealing material being deformable to permit said indentations to press or sink into said sealing material upon deformation of said side portion onto a container; and said ring-shaped seal having a thickness sufficient to substantially fill said spaces within said projections upon deformation of said side portion onto a container.

2. The cap-like closure system of claim 1, wherein said ring-shaped seal having a thickness such that, upon deformation of said side portion onto a container, said sealing material fills said spaces at least to the extent of said exposed edge.

3. The cap-like closure system of claim 2, wherein:

said sealing material comprises a rubber-like or foam-like material;

said ring-shaped seal comprises an outer surface and an inner surface; and said outer surface, compared to said inner surface, is devoid or essentially devoid of pores.

4. The cap-like closure system of claim 3, wherein said sealing material comprises an activatable material configured to be activated to increase the volume of said sealing material.

5. The cap-like closure system of claim 4, wherein said activatable material is configured to be activated by an input of thermal energy or other energy to expand said activatable material.

6. The cap-like closure system of claim 4, wherein said sealing material comprises a memory material configured to be compressed from an initial volume form to a reduced volume form upon application of pressure and, after pressure is removed, to remain compressed at the reduced volume form for a period of time and then gradually return to the initial volume form again.

7. The cap-like closure system of claim 6, wherein said seal comprises a seal cap having sufficient size to cover a container mouth opening and a container mouth side wall portion.

8. The cap-like closure system of claim 4, wherein said sealing material comprises one coat or a plurality of coats of a hot-melt adhesive.

9. The cap-like closure system of claim 2, wherein said seal comprises a seal cap having sufficient size to cover a container mouth opening and a container mouth side wall portion.

10. The cap-like closure system of claim 1, wherein said sealing material comprises an activatable material configured to be activated to increase the volume of said sealing material.

11. The cap-like closure system of claim 10, wherein said activatable material is configured to be activated by an input of thermal energy or other energy to expand said activatable material.

12. The cap-like closure system of claim 10, wherein said sealing material comprises a memory material configured to be compressed from an initial volume form to a reduced volume form upon application of pressure and, after pressure is removed, to remain compressed at the reduced volume form for a period of time and then gradually return to the initial volume form again.

13. The cap-like closure system of claim 10, wherein said sealing material comprises one coat or a plurality of coats of a hot-melt adhesive.

14. The cap-like closure system of claim 1, wherein said seal comprises a seal cap having sufficient size to cover a container mouth opening and a container mouth side wall portion.

15. A method of closing containers with the cap-like closure system according to claim 1, said method comprising the steps of:

first placing or forming a ring-shaped seal onto and about a neck or mouth portion of a container;

next placing a substantially flat, body portion of a crown cap preform onto a mouth portion of said container and covering an opening in said mouth portion, with a corrugated, side portion disposed about and extending substantially radially from said flat body portion and ending in an exposed edge;

deforming said side portion, which comprises aluminum or similar deformable metal, onto said exterior surface of said mouth portion of said container to secure said crown cap preform onto said container, and thus form a crown cap; and pressing or sinking teeth of said side portion, which teeth are formed by alternating projections and indentations, into said sealing material, and thereby substantially filling spaces within said projections and between said indentations.

16. The method of claim 15, wherein said step of placing or forming said ring-shaped seal onto and about said neck or mouth portion of said container comprises placing or forming said ring-shaped seal in a position on said container such that, after deformation of said side portion, said ring-shaped seal fills said spaces to the extent of said exposed edge or beyond said exposed edge.

17. The method of claim 16, wherein a portion of said sealing material, after deformation of said side portion, projects outwardly in the form of a ring or a collar disposed beneath said exposed edge to cover said exposed edge.

18. The method of claim 17, wherein said method further comprises chemically and/or physically curing and/or embrittling said portion of sealing material which projects outwardly after deformation of said side portion.

19. The method of claim 17, wherein said sealing material comprises an activatable material, and said method further comprises:

activating said activatable material, after deformation of said side portion, by indirectly applying energy to said crown cap or by directly applying energy to exposed portions of said sealing material; and at least temporarily altering the shape and/or state of said sealing material.

20. The method of claim 15, wherein said sealing material comprises an activatable material, and said method further comprises:

activating said activatable material, after deformation of said side portion, by indirectly applying energy to said crown cap or by directly applying energy to exposed portions of said sealing material; and at least temporarily altering the shape and/or state of said sealing material.

* * * * *